US011505357B2

(12) United States Patent
Purkey et al.

(10) Patent No.: US 11,505,357 B2
(45) Date of Patent: Nov. 22, 2022

(54) SLICED FOOD PRODUCT PACKAGE

(71) Applicant: Sargento Foods Inc., Plymouth, WI (US)

(72) Inventors: Todd Purkey, Elkhart Lake, WI (US); Jeff Karp, Elkhart Lake, WI (US)

(73) Assignee: Sargento Foods Inc., Plymouth, WI (US)

( * ) Notice: Subject to any disclaimer, the term of this patent is extended or adjusted under 35 U.S.C. 154(b) by 124 days.

(21) Appl. No.: 16/998,657

(22) Filed: Aug. 20, 2020

(65) Prior Publication Data

US 2022/0055788 A1 Feb. 24, 2022

(51) Int. Cl.

| | |
|---|---|
| ***B65D 1/36*** | (2006.01) |
| ***B65D 85/76*** | (2006.01) |
| ***B65D 75/00*** | (2006.01) |
| ***B65D 77/02*** | (2006.01) |

(52) U.S. Cl.

CPC ..... *B65D 1/36* (2013.01); *B65D 75/004* (2013.01); *B65D 77/02* (2013.01); *B65D 85/76* (2013.01); *B65D 2571/00018* (2013.01); *B65D 2571/00246* (2013.01)

(58) Field of Classification Search

CPC ..... B65D 1/36; B65D 43/02; B65D 43/021; B65D 43/0218; B65D 43/0254; B65D 75/004; B65D 75/22; B65D 75/36; B65D 75/366; B65D 77/32; B65D 85/62; B65D 85/76; B65D 2571/00018; B65D 2571/00246; B65D 75/30; B65D 75/32; B65D 75/326; B65D 75/52; B65D 75/522; B65D 75/54

USPC ..... 206/205, 499; 426/106–131, 396

See application file for complete search history.

(56) References Cited

U.S. PATENT DOCUMENTS

| | | | | |
|---|---|---|---|---|
| 3,051,584 | A * | 8/1962 | Tindall | B65D 5/4204 206/820 |
| 3,338,723 | A * | 8/1967 | Lundquist | B65D 75/32 426/121 |
| 3,703,384 | A * | 11/1972 | Seiferth et al. | B65D 75/30 426/123 |
| 4,003,184 | A * | 1/1977 | Shiu | B65B 25/065 426/121 |
| 5,002,781 | A * | 3/1991 | Van Erden | B65D 33/2533 426/106 |
| 5,074,416 | A * | 12/1991 | Hustad | B65D 75/32 426/106 |
| 5,520,939 | A * | 5/1996 | Wells | B65D 75/32 426/106 |
| 5,795,604 | A * | 8/1998 | Wells | B65D 75/32 426/106 |
| 7,172,779 | B2 * | 2/2007 | Castellanos | B65D 1/34 426/106 |
| 8,354,131 | B2 * | 1/2013 | Gan | B65D 81/3453 426/94 |

(Continued)

FOREIGN PATENT DOCUMENTS

| | | | | |
|---|---|---|---|---|
| EP | 1288137 | A2 * | 3/2003 | B65D 77/20 |

*Primary Examiner* — Bryon P Gehman

(74) *Attorney, Agent, or Firm* — Boyle Fredrickson, SC

(57) ABSTRACT

A food product package for containing a shingled stack of food product slices is provided including a package bottom and a non-planar periphery, the package bottom having walls oriented to be substantially the same geometry as the shingled stack of food product slices.

20 Claims, 11 Drawing Sheets

(56) References Cited

U.S. PATENT DOCUMENTS

| | | | | |
|---|---|---|---|---|
| 8,911,807 | B2 * | 12/2014 | Hinze | B65D 85/62 426/123 |
| 2005/0233036 | A1 * | 10/2005 | Feldmeier | B65D 77/208 426/121 |
| 2008/0160143 | A1 * | 7/2008 | Edwards | B65D 43/0218 426/106 |
| 2009/0142454 | A1 * | 6/2009 | Clark | B65D 1/40 426/396 |
| 2015/0367982 | A1 * | 12/2015 | Tilahun | B65D 75/28 426/106 |

* cited by examiner

SLICED FOOD PRODUCT PACKAGE

FIELD OF THE INVENTION

The subject matter disclosed herein relates to food product packages, and more specifically, relates to food product packages for containing a shingled stack of food product slices.

BACKGROUND OF THE INVENTION

Food product packages for containing a shingled stack of food product slices often include excess head space, do not maintain the stack in its shingled orientation, use a vacuum when sealing the package, have a decreased shelf life, and use interleaving or interleave paper.

SUMMARY OF THE INVENTION

In one construction, the disclosure provides a package for containing a shingled stack of food product slices. The package includes a package bottom having a bottom wall, an angled wall at an angle relative to the bottom wall, and a pair of side walls. The bottom wall, side walls and angled wall defining an interior. The package includes a shingled stack of food product slices housed in the interior such that the bottom most food product slice in the shingled stack is supported by the bottom wall and at least some of the remainder of the food product slices in the shingled stack contact the angled wall. The package includes a package top adapted to enclose the shingled stack of food slices in the interior.

In another construction, the disclosure provides food product package for containing a shingled stack of food product slices having a geometry. The package includes a package bottom including a plurality of walls formed from thermoformed roll stock film and a non-planar seal flange, the walls being oriented to be substantially the same geometry as the shingled stack of food product slices, and a package top sealable to the seal flange.

In another construction, the disclosure provides a package bottom for a food product package for containing a shingled stack of food product slices having a parallelepiped geometry. The package bottom includes a plurality of walls oriented to be substantially the same parallelepiped geometry as the shingled stack of food slices to reduce the amount of head space in the package.

In another construction, the disclosure provides a food product package for containing food product slices having a geometry. The package includes a package bottom including a plurality of walls and a non-planar seal flange, the walls being oriented to be substantially the same geometry as the food product slices, and a package top sealable to the seal flange.

BRIEF DESCRIPTION OF THE DRAWINGS

Preferred exemplary embodiments of the invention are illustrated in the accompanying drawings in which like reference numerals represent like parts throughout, and in which.

Figure 1:
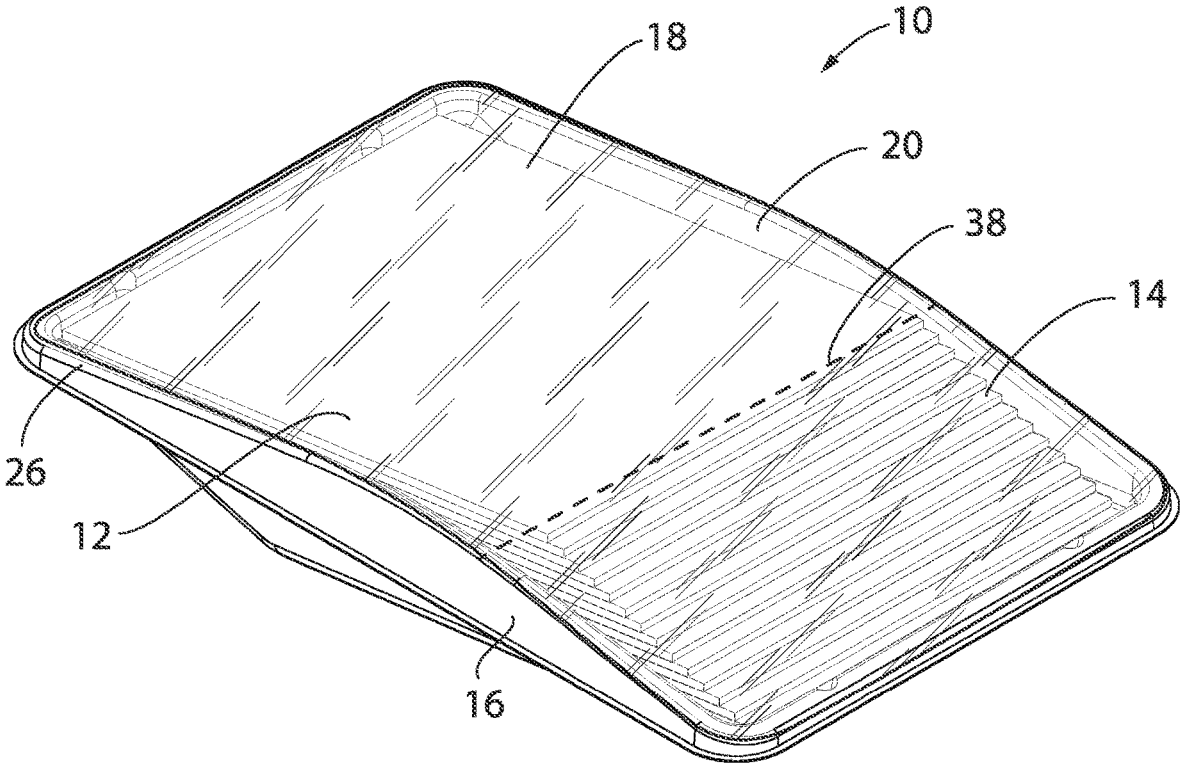
FIG. 1 is a perspective view of a package bottom with cheese contained therein and a package top in a closed position of the present invention.

Before any embodiments of the invention are explained in detail, it is to be understood that the invention is not limited in its application to the details of constructions and the arrangement of components set forth in the following description or illustrated in the drawings. The invention is capable of other embodiments and of being practiced or of being carried out in various ways.

DETAILED DESCRIPTION

With reference to FIG. 1, therein is shown a package 10 for containing food product slices 12 in a shingled stack 14. The shingled stack 14 can contain any number of individual food product slices and contain food product slices in varying shapes. The food product slices 12 as shown in the drawings is a shingled stack of individual square cheese slices. However, the food product can be other types of food or multiple types of foods in a shingled stack and can be in shapes other than square such as rectangular.

The package 10 includes a package bottom 16 and package top 18 defining therebetween an interior 20 for containing the shingled stack 14 of food product slices 12.

Turning to FIGS. 3-10, the package bottom 16 has a geometry that is approximately the same as the geometry of the shingled stack 14 of food product slices 12 thus reducing head space in the interior 20. A reduction of head space in the interior 20 ensures that each food product slice 12 maintains its shingled orientation. A reduction in head space reduces the propensity for condensate to form inside the package 10 which helps ensure that moisture does not come in direct contact with the food product slices 12, thus improving product quality. A reduction in head space aids in and contributes to a lower percentage of residual oxygen in the interior 20 of the package 12. Lower oxygen levels equate to longer shelf live and higher quality for the food product slices 12. A reduction in head space can reduce the formation of lactate crystals which degrades the shelf life and quality of the food product slices 12.

To approximate the geometry of the shingled stack 14 of food product slices 12, preferably the bottom package 16 has a plurality of walls 22 such as four walls for example. However, other numbers of walls 22 can also be utilized. The four walls 22 include a bottom wall 22A, an angled wall 22B and two side walls 22C, 22D.

The bottom wall 22A is preferably flat. The angled wall 22B extends upwardly from the bottom wall 22A at an angle A that is approximately the same as the angle of the shingled stack 14. The angled wall 22B can be flat, however, preferably the angled wall 22B has ridges 24 thereon. The ridges 24 assist in maintaining the position of the shingled stack 14 within the package 10.

The side walls 22C, 22D can be flat but preferably are stepped outwardly. The side walls 22C, 22D are shaped to conform to the geometry of the shingled stack 14.

Figure 10:
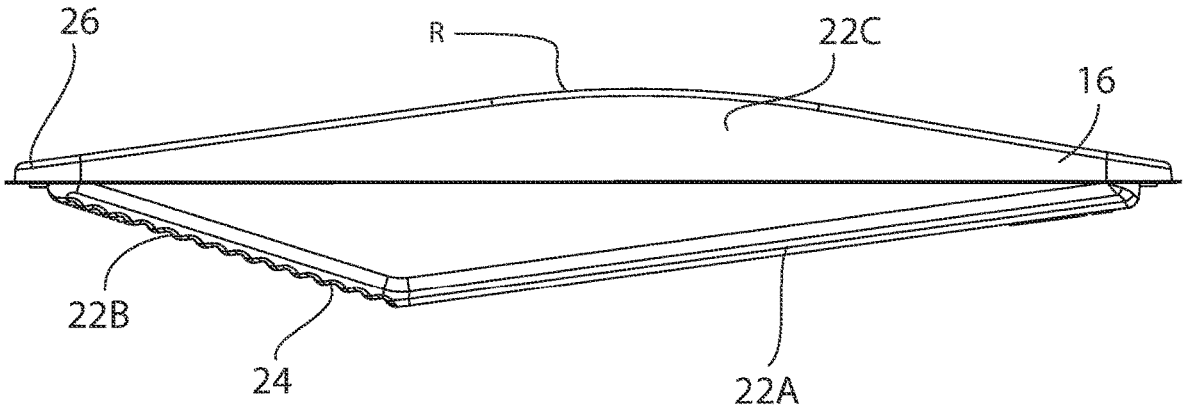
FIG. 10 is a side view of the package bottom.

The package bottom 16 has a seal flange 26 preferably around its periphery that is not planar, i.e., the entire seal flange 26 is not in the same plane. Specifically, the seal flange 26 is curved with preferably a curved portion along each side wall 22C and 22D and having a radius of curvature R (FIG. 10). Specifically, the curved seal flange 26 provides a surface onto which the package top 18 can be attached or sealed. It should be particularly noted that the seal flange 26 is not planar or flat as is standard in the art. The curve of the seal flange 26 follows the contours of the shingled stack 14 which reduces head space inside the package 10. A reduction in head space has the advantages as previously described. The curve of the seal flange 26 aids in maintaining the shingled stack 14 orientation.

The package bottom 16 can also include a finger channel 30 to enable and assist a consumer in removing an individual food product slice 12 from the package 10.

The package bottom 16 can also include one or more channels (not shown) to aide in the entrapment of moisture within the package 10 through capillary action as is known in the art.

Figure 11:
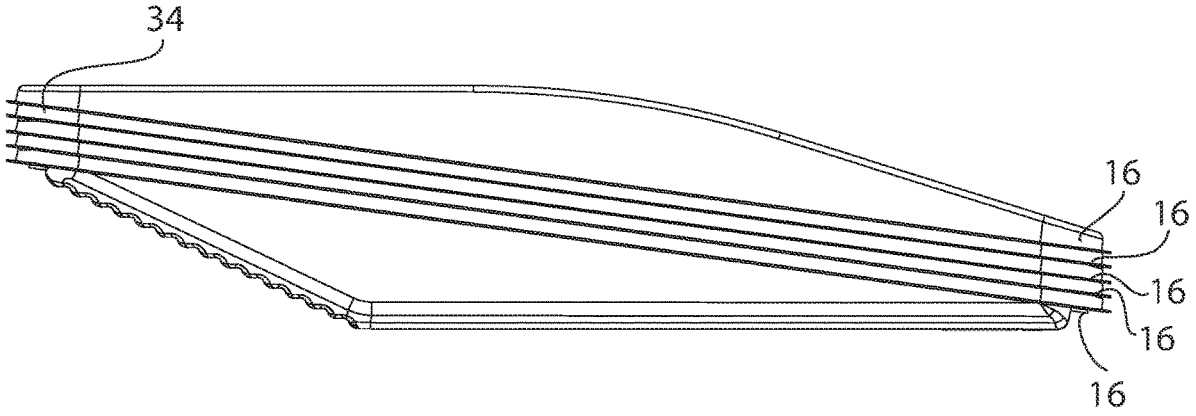
FIG. 11 is a view of multiple package bottoms being stacked.

As shown in FIG. 11, the package bottom 16 can include one or more stacking lugs 34 to aid in the stacking of multiple package bottoms 16.

The package bottom 16 is preferably manufactured by thermoforming roll stock film, however, other materials and processes can also be utilized. The material thickness of the package bottom 16 is preferably in the range of 12 mil to 15 mil, for example, however other thickness can also be utilized. Clear or pigmented colorant can be added during manufacture to aid in further differentiation of the package 10 from competitors and/or to protect the food product slices 12 from the effects of light. The package bottom 16 can be formed in line or can be supplied pre-made.

Turning back to FIG. 1, the package top 18 seals the food product slices 12 in the package 10 in its closed position. Preferably, the package top 18 is sealed to the curved seal flange 26 of the package bottom 16, however, other processes can also be utilized. The package top 18 can be manufactured from roll stock film or die cut lid stock with a material thickness that ranges from 5 mil to 8 mil for example, however, other thickness can also be used. The lid stock thickness in the range from 5 mil to 8 mil aides in a more secure closure.

Figure 2:
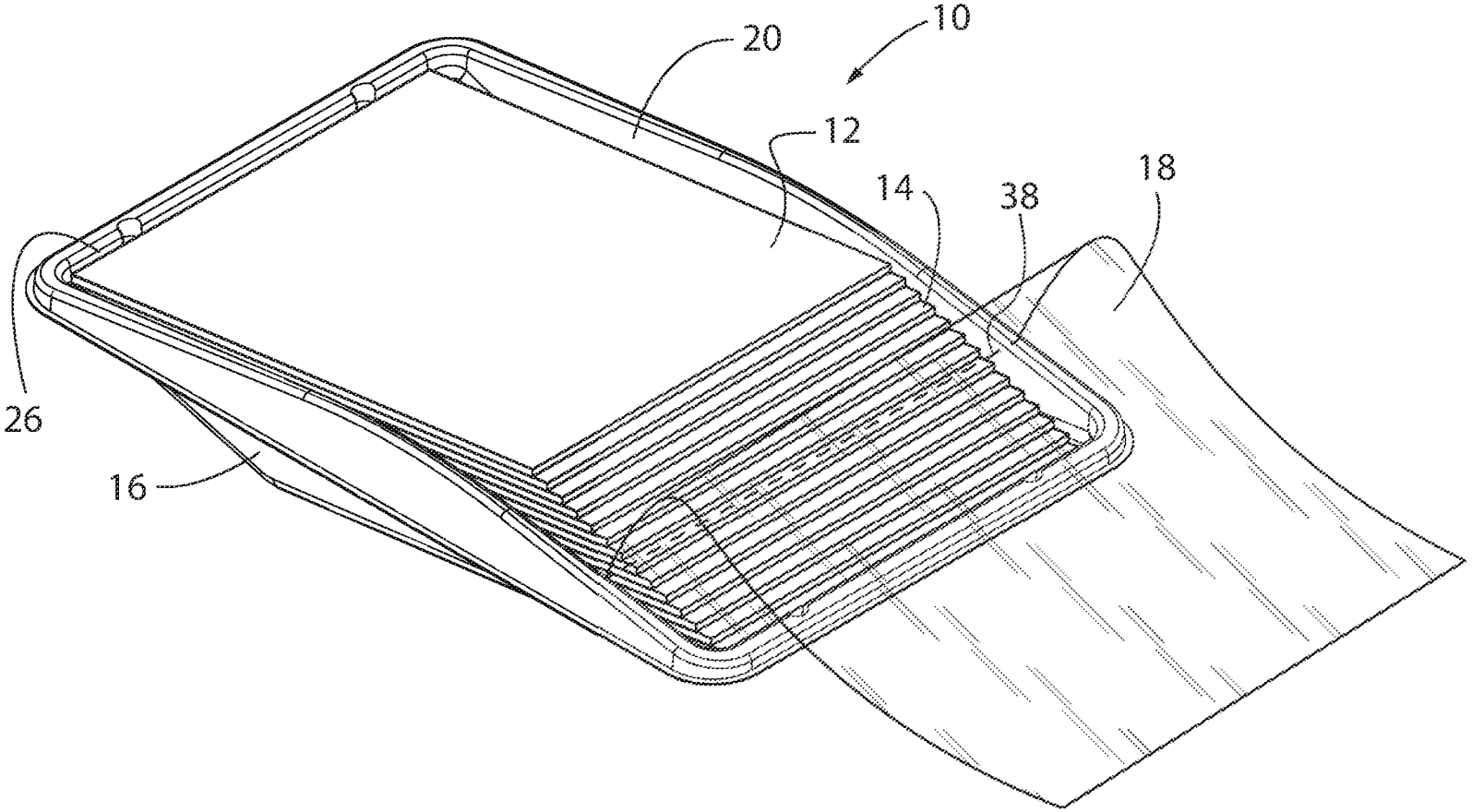
FIG. 2 is a perspective view of the package bottom with cheese contained therein and the package top in an open position.
Figure 3:
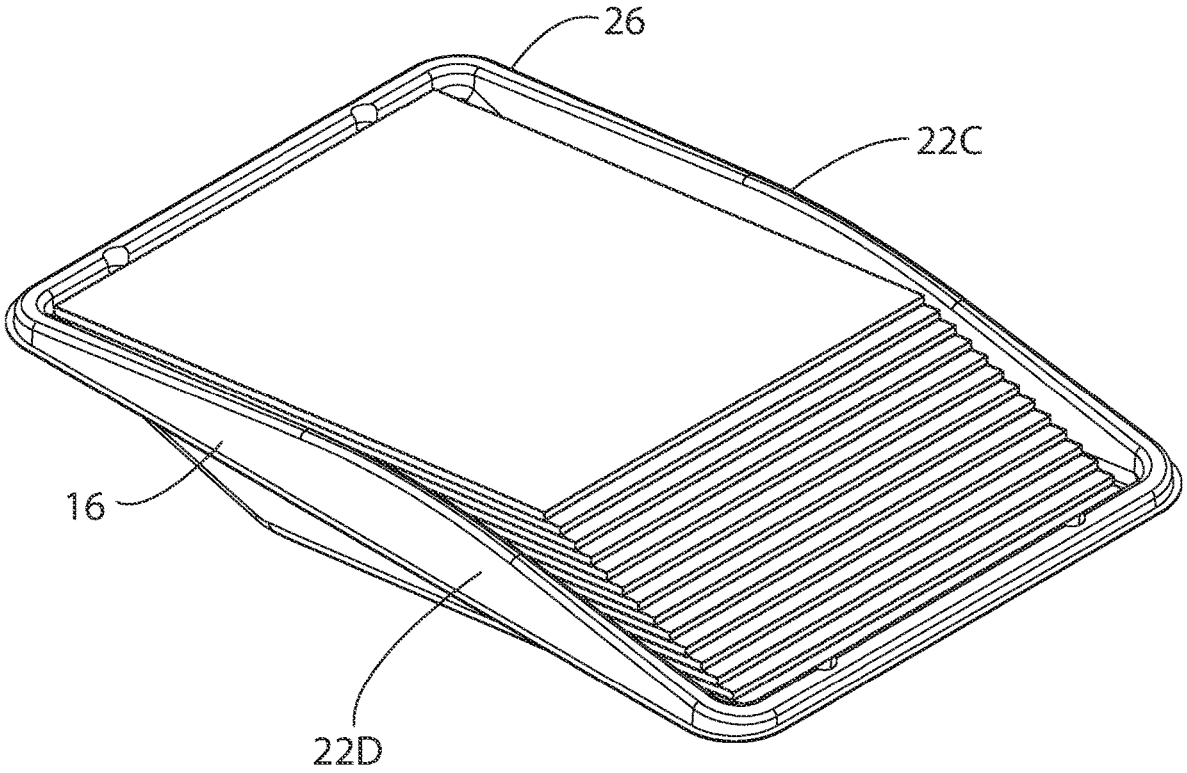
FIG. 3 is a perspective view of the package bottom with cheese contained therein.
Figure 4:
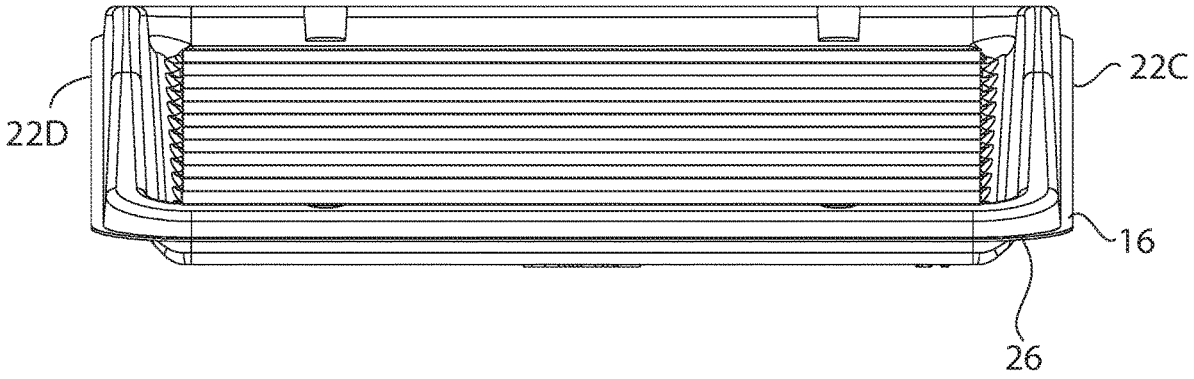
FIG. 4 is an end view of the package bottom with cheese contained therein.
Figure 5:
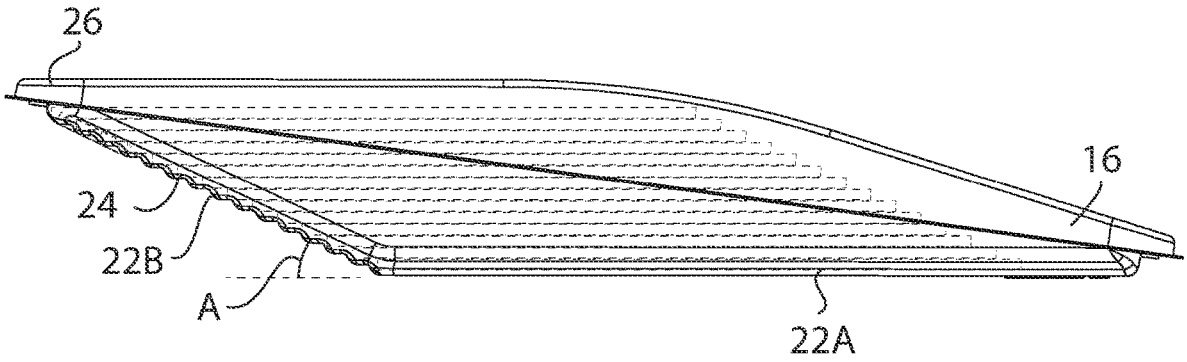
FIG. 5 is a side view of the package bottom with cheese contained therein.
Figure 6:
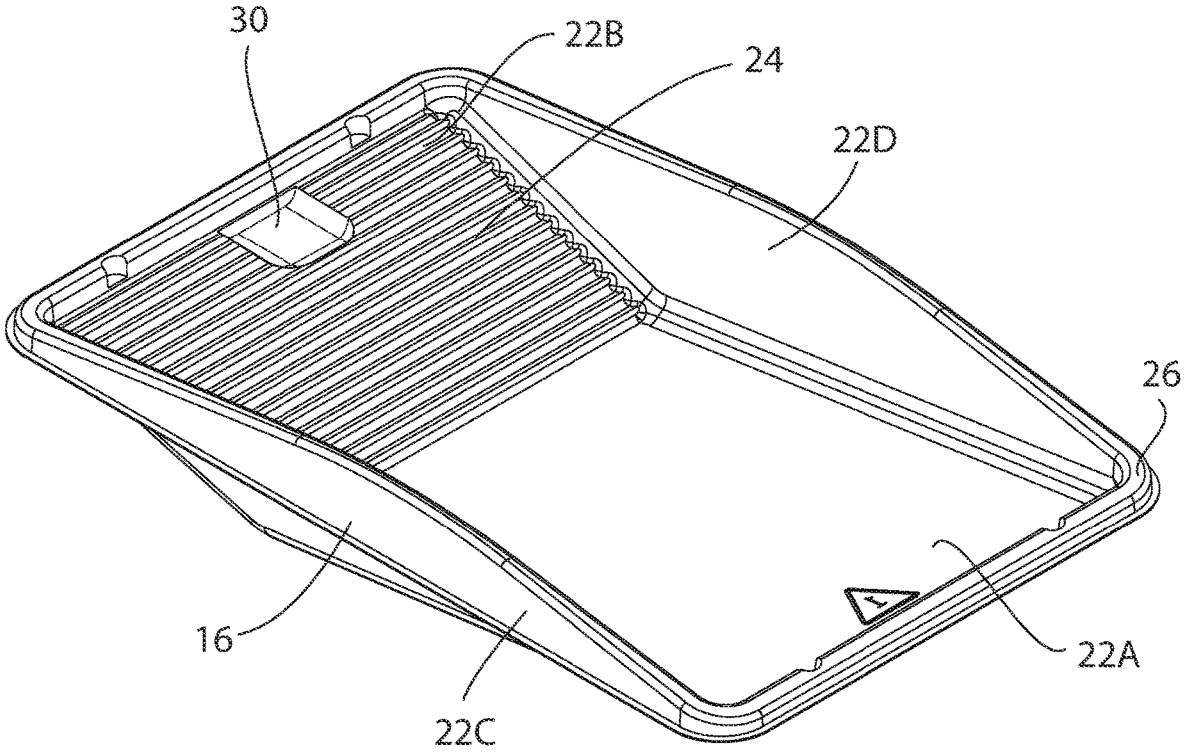
FIG. 6 is a perspective view of the package bottom.
Figure 7:
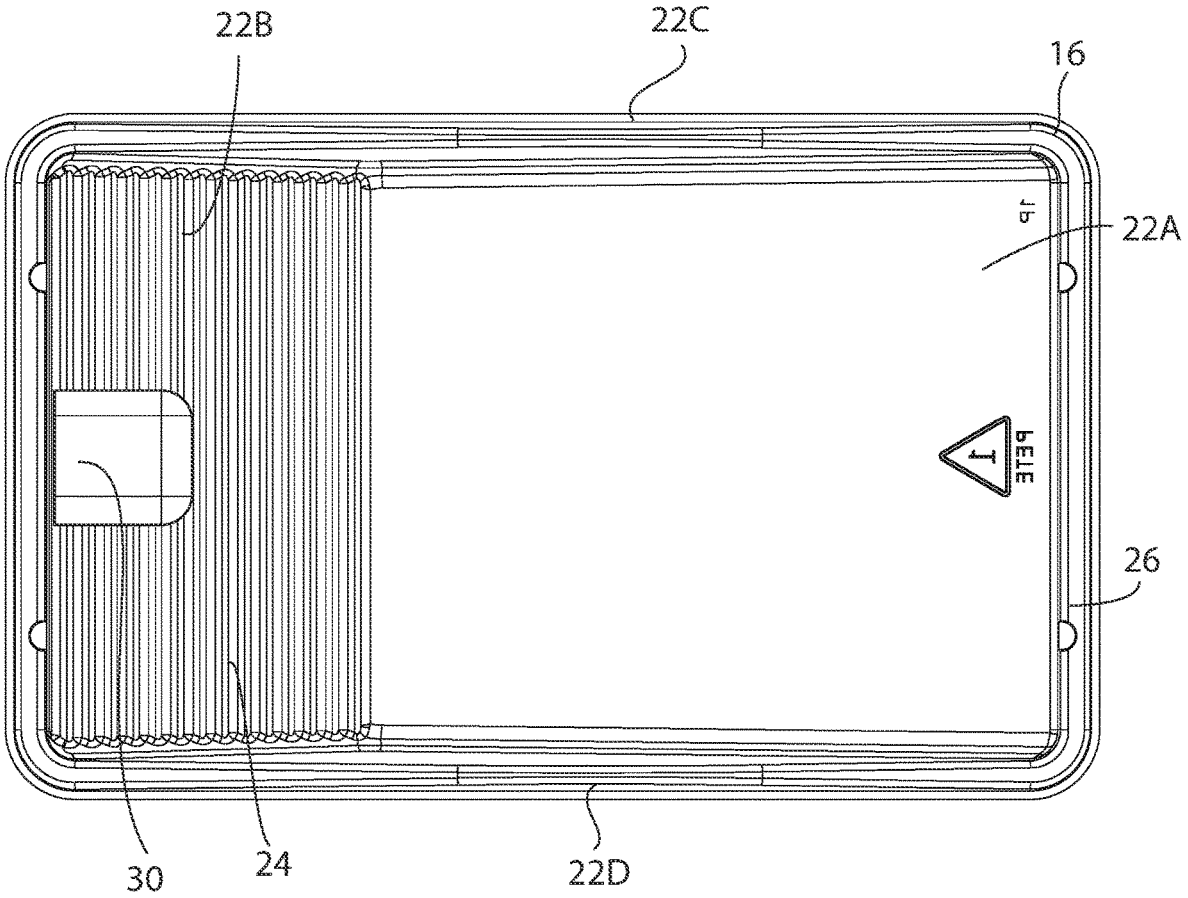
FIG. 7 is a top view of the package bottom.
Figure 8:
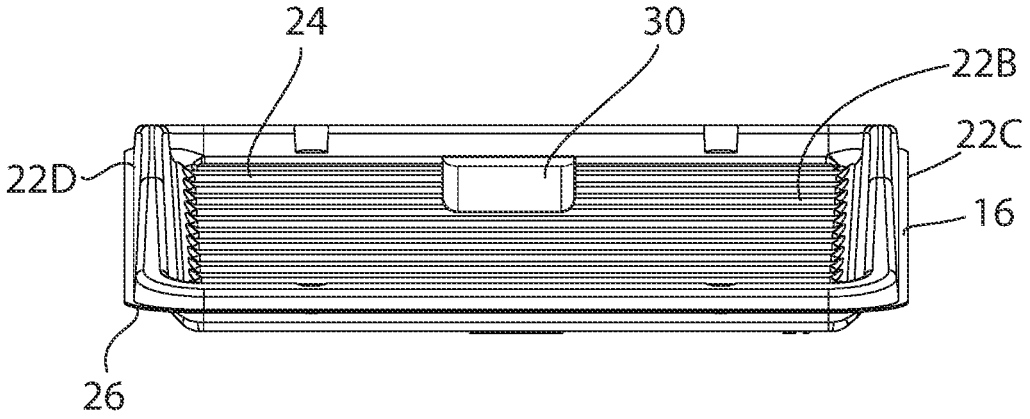
FIG. 8 is an end view of the package bottom.
Figure 9:
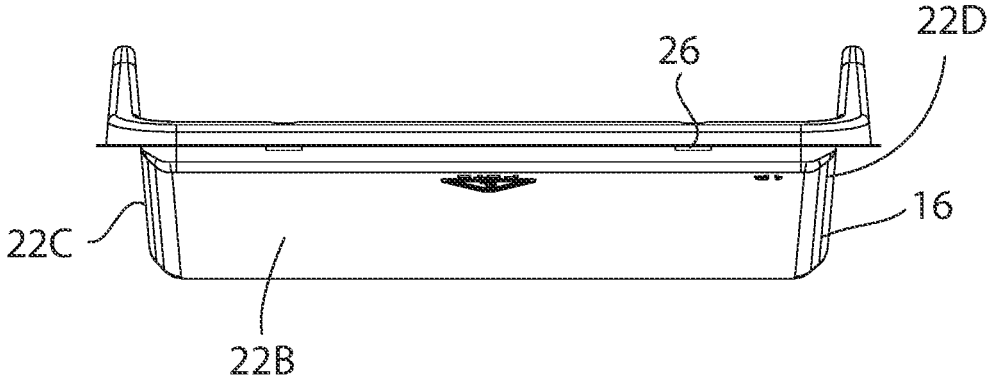
FIG. 9 is an end view of the package bottom.

The package top 18 provides for easy closure of the package 10 from its open position (FIG. 2) to its closed position (FIG. 1) as it inherently folds back along the curved seal flange 26 due to memory of the package top 18 material. The package top 18 can also include a crease 38 preferably located at its midpoint but can also be located in a different position along the package top 18. The crease 38 can be applied by either laser score or mechanical means. The crease 38 is applied to the outer surface of the package top 18 such that it acts as a hinge when opening. This ensures that the consumer is not hindered while removing a slice of cheese from the package 10 due to spring back or memory of the package top 18 as its tendency is to reclose. The crease 38 aids in closure of the package 10 as well. The package top 18 preferably includes a lock down seal 40 to ensure that the package top 18 cannot be inadvertently detached or removed from the package 10.

The curved seal flange 26 together with the package top 18 provides for peel and reseal of the package 10 with an opportunity for multiple opening and closure occurrences, such as for example, twenty occurrences.

With respect to labels, the angled wall 22B can be utilized to display a label such as an in-mold label (not shown) and be presented to the consumer as the front panel of the package 10. Alternately, the package top 18 can receive a pre-printed label (not shown) and be presented to the consumer as the front panel of the package 10. As alternatives, the thermoformed package bottom can be preprinted thereby not requiring application of a label or preprinted film on roll stock that is later thermoformed may include indicia such as an ingredient statement, product information, UPC code and the like.

Optionally, the package 10 can also include oxygen scavengers (not shown) that aide in extending the shelf life of the food product slices 12 contained in the package 10.

During manufacturing, the package 10 is preferably flushed with nitrogen and/or carbon dioxide thereby preventing the food product slices 12 from knitting together due to elimination of vacuum packing. Accordingly, and as shown, there is no need for interleaving or interleaf paper between the food product slices 12 as the slices are not subjected to vacuum. However, interleaf paper can be utilized with the present invention if desired.

During manufacture, a seal head which protrudes up into a seal box seals the package top 18 onto the curved seal flange 26. During manufacture with the curved seal flange 26, the seal integrity would be equal to that of a flat seal relative to hermeticity. The seal head would provide a higher sealing temperature at one end of the package 10 to form the lock down seal 40 to ensure that the package top 18 cannot be removed from the package bottom 16. If the package top 18 is composed of a die cut lid stock, during manufacture, a feed system would ensure that the package top 18 is properly positioned and aligned with the package bottom 16 prior to sealing. If the package top 18 is composed of roll stock film, during manufacture, a feed system would ensure that the package top 18 is properly fed into and draped along and around the seal flange 26 prior to sealing. Such a package top 18 may require a preheat station to ensure that the package top 18 takes the shape or contour of the curved seal flange 26 prior to and during the sealing process.

The package 10 can be designed with the intent of being recyclable while also providing sufficient barrier properties that will lead to the required food product shelf life. Non-recyclable materials may also be utilized to protect the food product slices 12 contained in the package 10.

The package 10 as shown in the drawings is designed as a shelf ready package. However, a peg hole (not shown) in the package 10 can be used to traditionally merchandize the package 10.

Various features and advantages of the invention are set forth in the following claims.

We claim:

1. A package for containing a shingled stack of food product slices, said package comprising:

a package bottom having a periphery, a bottom wall, an angled wall at an angle relative to the bottom wall, an end wall and a pair of side walls, wherein the bottom wall, the side walls, the end wall and the angled wall define an interior and wherein the periphery is non-planar;

a shingled stack of food product slices housed in the interior wherein each slice is in a parallel plane with the bottom wall; and a flexible film package top sealed to the package bottom to enclose the shingled stack of food slices in the interior and having a first portion that remains sealed to the package bottom and a second portion that is unsealable from and resealable to the package bottom;

wherein each side wall has a curved portion adjacent to the slice on a top of the shingled stack.

2. The package of claim 1 wherein the shingled stack of food product slices is adjacent each of the side walls.

3. The package of claim 1 and further including a lock down seal so that the first portion of the package top cannot be inadvertently unsealed from the package bottom.

4. The package of claim 1 wherein the package bottom is composed of thermoformed roll stock film that is 12-15 mil thick.

5. The package of claim 1 wherein the package top is composed of roll stock film that is 5-8 mil thick.

6. The package of claim 1 wherein the package top has a crease on the second portion that acts as a hinge when the second portion is unsealed from the package bottom.

7. The package of claim 1 wherein the package has a minimized amount of head space.

8. The package of claim 1 wherein the package bottom has a finger channel to assist in removing individual food product slices from the interior.

9. The package of claim 1 wherein the interior is flushed with one of nitrogen and carbon dioxide eliminating the need for applying a vacuum.

10. A package for containing a shingled stack of food product slices, said package comprising:

a package bottom having a bottom wall, an angled wall at an angle relative to the bottom wall, and a pair of side walls, the bottom wall, side walls and angled wall defining an interior;

a shingled stack of food product slices housed in the interior such that the bottom most food product slice in the shingled stack is supported by the bottom wall and at least some of the remainder of the food product slices in the shingled stack contact the angled wall; and a package top adapted to enclose the shingled stack of food slices in the interior;

wherein the angled wall includes a plurality of ridges to assist in maintaining the food product slices in the shingled stack.

11. A package for containing a shingled stack of food product slices, said package comprising:

a package bottom having a periphery, a bottom wall, an angled wall at an angle relative to the bottom wall, and a pair of side walls, wherein the bottom wall, the side walls, and the angled wall define an interior;

a shingled stack of food product slices housed in the interior such that each slice is in a parallel plane with the bottom wall; and a flexible film package top sealed to the package bottom to enclose the shingled stack of food slices in the interior and having a first portion that remains sealed to the package bottom and a second portion that is unsealable from and resealable to the package bottom;

wherein each side wall has a curved portion with a first straight portion and a second straight portion on either side of the curved portion.

12. A package for containing a shingled stack of food product slices, said package comprising:

a package bottom having a bottom wall, an angled wall at an angle relative to the bottom wall, and a pair of side walls, the bottom wall, side walls and angled wall defining an interior;

a shingled stack of food product slices housed in the interior such that the bottom most food product slice in the shingled stack is supported by the bottom wall and at least some of the remainder of the food product slices in the shingled stack contact the angled wall; and a package top adapted to enclose the shingled stack of food slices in the interior, the package top having a crease and wherein the crease is laser cut.

13. A food product package for containing a shingled stack of food product slices having a geometry, said package comprising:

a shingled stack of food product slices having a geometry and wherein the slices are parallel to each other;

a package bottom including a plurality of walls formed from thermoformed roll stock film and a periphery that is non-planar, the walls being oriented to be substantially the same geometry to contain the shingled stack of food product slices; and a flexible film package top sealable to the package bottom to enclose the shingled stack of food products, the package top having a first portion that remains sealed to the package bottom and a second portion that is unsealable from and resealable to the package bottom, wherein the package top has a crease that acts as a hinge when the second portion is unsealed from the package bottom.

14. The food product package of claim 13 wherein one of the plurality of walls includes a plurality of ridges to assist in maintaining the food product slices in the shingled stack.

15. The food product package of claim 13 and further including a lock down seal to prevent the first portion of the package top from being inadvertently unsealed from the package bottom.

16. The food product package of claim 13 wherein the at least two of the walls include at least one curved portion.

17. The food product package of claim 16 wherein the curved portion is generally located in the center portion of each of the at least two walls.

18. A package bottom for a food product package for containing a shingled stack of food product slices having a parallelepiped geometry, said package bottom comprising:

a plurality of walls oriented to be substantially the same parallelepiped geometry as the shingled stack of food slices to reduce the amount of head space in the package; and wherein the plurality of walls includes a pair of side walls with each side wall having a curved portion with a first straight portion and a second straight portion on either side of the curved portion, and wherein the first and the second straight portions are generally the same length and are located directly above the bottom wall.

19. The package bottom of claim 18 and further including a non-planar periphery and a seal flange around the periphery.

20. The package bottom of claim 18 wherein the walls are composed of thermoformed roll stock film.

* * * * *